US009644831B2

(12) United States Patent
Johnson, III et al.

(10) Patent No.: US 9,644,831 B2
(45) Date of Patent: May 9, 2017

(54) INTELLIGENT MANIFOLD ASSEMBLIES FOR A LIGHT SOURCE, LIGHT SOURCES INCLUDING INTELLIGENT MANIFOLD ASSEMBLIES, AND METHODS OF OPERATING THE SAME

(71) Applicant: Heraeus Noblelight America LLC, Gaithersburg, MD (US)

(72) Inventors: William E. Johnson, III, Burke, VA (US); Darrin Leonhardt, Gaithersburg, MD (US); William Curtis Harper, Middletown, MD (US); Mahmood Gharagozloo, Gaithersburg, MD (US); Arunachalam Jawahar, Thenkalam (IN)

(73) Assignee: Heraeus Noblelight America LLC, Gaithersburg, MD (US)

( * ) Notice: Subject to any disclaimer, the term of this patent is extended or adjusted under 35 U.S.C. 154(b) by 59 days.

(21) Appl. No.: 14/994,253

(22) Filed: Jan. 13, 2016

(65) Prior Publication Data

US 2016/0209019 A1 Jul. 21, 2016

Related U.S. Application Data

(60) Provisional application No. 62/103,936, filed on Jan. 15, 2015.

(51) Int. Cl.

| | |
|---|---|
| ***F21V 29/57*** | (2015.01) |
| ***B05D 3/06*** | (2006.01) |
| ***B41F 23/04*** | (2006.01) |
| ***F26B 3/28*** | (2006.01) |
| ***F26B 3/30*** | (2006.01) |

(52) U.S. Cl.

CPC ..... *F21V 29/57* (2015.01); *B05D 3/061* (2013.01); *B05D 3/067* (2013.01); *B41F 23/044* (2013.01); *F26B 3/28* (2013.01); *F26B 3/30* (2013.01)

(58) Field of Classification Search

None

See application file for complete search history.

(56) References Cited

U.S. PATENT DOCUMENTS

| | | | |
|---|---|---|---|
| 4,710,638 | A | 12/1987 | Wood |
| 8,872,137 | B2 | 10/2014 | Childers |

(Continued)

FOREIGN PATENT DOCUMENTS

| | | |
|---|---|---|
| CN | 102518971 | 6/2012 |
| DE | 102006016529 | 10/2007 |

(Continued)

OTHER PUBLICATIONS

International Search Report for International Patent Application No. PCT/US2016/013333, dated Apr. 7, 2016.

*Primary Examiner* — Jany Richardson

(74) *Attorney, Agent, or Firm* — Stradley Ronon Stevens & Young, LLP

(57) ABSTRACT

A manifold assembly for distribution of a cooling fluid configured for use with a light source is provided. The manifold assembly includes a fluid manifold for providing a cooling fluid to a lamp head assembly of the light source, at least one sensor for sensing at least one characteristic of the cooling fluid in the fluid manifold, and a microprocessor for receiving information related to the at least one characteristic from the at least one sensor.

20 Claims, 6 Drawing Sheets

(56) References Cited

U.S. PATENT DOCUMENTS

| | | | | |
|---|---|---|---|---|
| 2005/0276053 | A1* | 12/2005 | Nortrup ..... | F21S 48/325<br>362/294 |
| 2011/0147356 | A1 | 6/2011 | Leonhardt et al. | |
| 2013/0114263 | A1 | 5/2013 | Peil et al. | |
| 2014/0014857 | A1 | 1/2014 | Martinez et al. | |
| 2014/0131755 | A1 | 5/2014 | Owen et al. | |
| 2014/0328579 | A1 | 11/2014 | Childers | |

FOREIGN PATENT DOCUMENTS

| | | |
|---|---|---|
| JP | 2011150862 | 8/2011 |
| WO | 2009035238 | 3/2009 |
| WO | 2011094293 | 8/2011 |

* cited by examiner

INTELLIGENT MANIFOLD ASSEMBLIES FOR A LIGHT SOURCE, LIGHT SOURCES INCLUDING INTELLIGENT MANIFOLD ASSEMBLIES, AND METHODS OF OPERATING THE SAME

CROSS-REFERENCE TO RELATED APPLICATION

This application claims the benefit of U.S. Provisional Patent Application No. 62/103,936, filed Jan. 15, 2015, the content of which is incorporated herein by reference.

FIELD

The invention relates to manifold assemblies for distributing cooling fluids for light sources, and more particularly, to intelligent manifold assemblies for use with light sources.

BACKGROUND

Lamp systems including light producing elements (e.g., ultraviolet radiation LEDs, also known as UV LEDs) are used in connection with many applications such as, for example, UV curing applications (e.g., UV curing of inks, bonding agents such as adhesives, coatings, etc.). Certain light producing devices (e.g., a group of UV LEDs) produce a substantial amount of heat, and are typically cooled using a cooling fluid.

For example, the cooling fluid may be water provided by a chiller system. It is typically desirable to maintain certain characteristics (e.g., water flow rate) of the cooling fluid. Further, in certain instances, it is desirable to shut off flow of the cooling fluid used to cool the lamp systems.

Existing cooling fluid distribution systems, and the monitoring, control, and operation of such systems, do not adequately address the complex issues that arise in the industry.

Thus, it would be desirable to provide improved cooling fluid distribution systems, light sources including such improved cooling fluid distribution systems, and methods of operating such improved cooling fluid distribution systems, to overcome one or more of the deficiencies in the industry.

SUMMARY

According to an exemplary embodiment of the invention, a manifold assembly for distribution of a cooling fluid is provided. The manifold assembly is configured for use with a light source. The manifold assembly includes a fluid manifold for providing a cooling fluid to a lamp head assembly of the light source, at least one sensor for sensing at least one characteristic of the cooling fluid in the fluid manifold, and a microprocessor for receiving information related to the at least one characteristic from the at least one sensor.

According to another exemplary embodiment of the invention, a light source is provided. The light source includes: (a) a lamp head assembly including at least one light producing device; and (b) a manifold assembly for distributing a cooling fluid, the manifold assembly being configured for use with the light source, the manifold assembly including (i) a fluid manifold for providing the cooling fluid to the lamp head assembly, (ii) at least one sensor for sensing at least one characteristic of the cooling fluid in the fluid manifold, and (iii) a microprocessor for receiving information related to the at least one characteristic of the cooling fluid from the at least one sensor.

According to yet another exemplary embodiment of the invention, a method of operating a manifold assembly for distributing a cooling fluid is provided. The manifold assembly is configured for use with a light source. The method includes the steps of: (a) providing a cooling fluid to the manifold assembly for cooling a light source; (b) sensing at least one characteristic of the cooling fluid at the manifold assembly using at least one sensor; and (c) transmitting data including information related to the at least one characteristic sensed by the at least one sensor to a microprocessor included in the manifold assembly.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION

Figure 1:
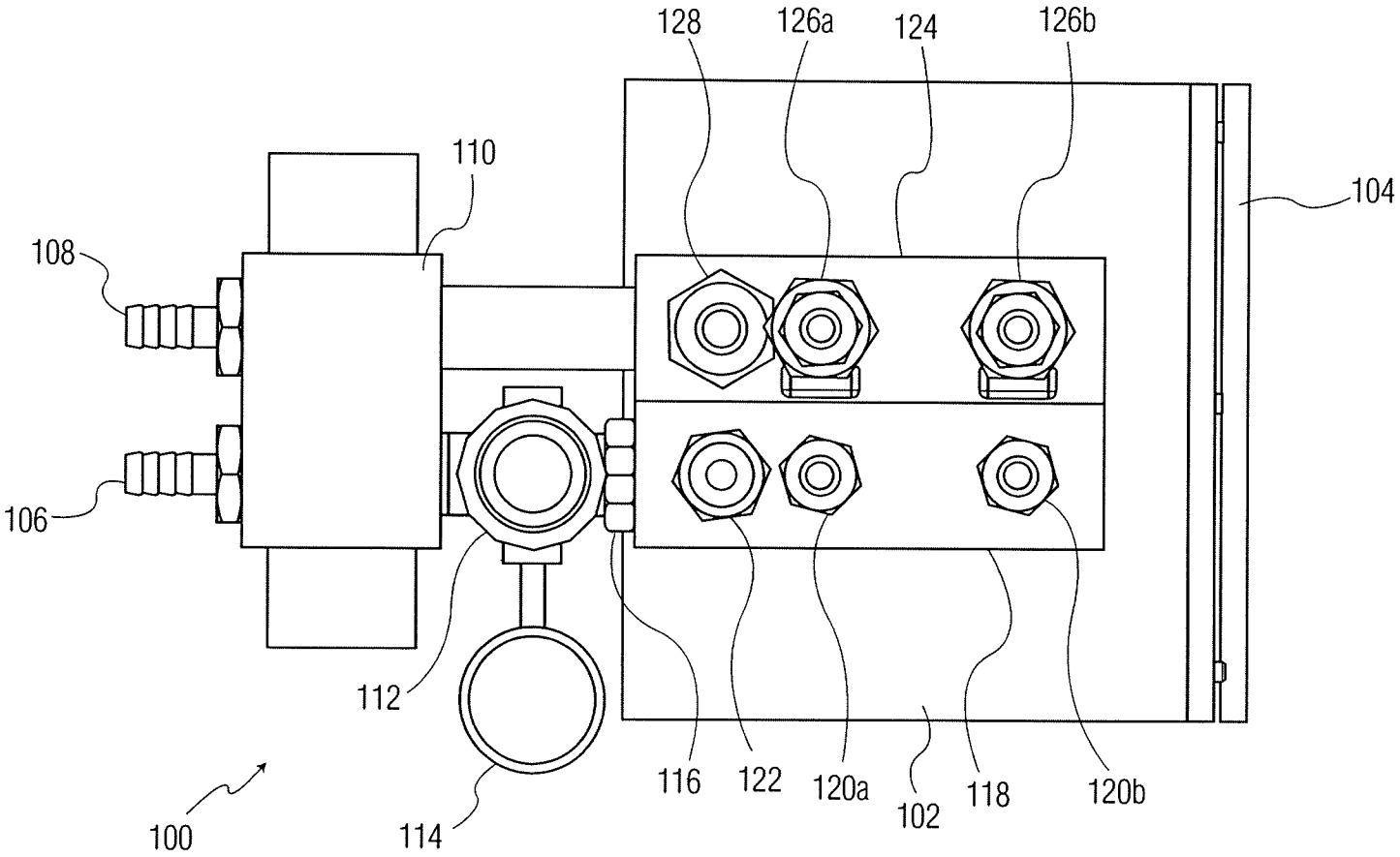
FIG. 1 is a top view of a manifold assembly in accordance with an exemplary embodiment of the invention.

The invention may have particular applicability to manifold assemblies configured for use with light sources such as UV light sources. Exemplary UV light sources include UV lasers, UV LED light sources, and vertical cavity surface emitting lasers (VCSEL). Nonetheless, other light sources, such as visible light sources, are contemplated.

As used herein, the terms "processor" and "microprocessor" are used interchangeably, and shall be broadly construed to refer to any device including a processing unit (e.g., a central processing unit) or other hardware that executes computer program instructions. Examples of "processors" and "microprocessors" include microcontrollers, digital signal processors (DSPs), programmable logic controllers (PLCs), computers, etc. As is understood by those skilled in the art, "processors" and "microprocessors" may include elements such as random access memory (RAM), read only memory (ROM), and peripherals.

Certain embodiments of the invention relate to an intelligent manifold assembly for use with (and/or inclusion in) a light source, such as an ultraviolet (UV) light source or a visible light source. The intelligent manifold assembly may be configured to report certain characteristics related to a cooling fluid in the manifold assembly (or other elements of a light source) such as, for example: inlet flow rate of the cooling fluid, outlet flow rate of the cooling fluid, pH of the cooling fluid, pressure of the cooling fluid, inlet temperature of the cooling fluid, outlet temperature of the cooling fluid, and ambient temperature of the system. Various benefits may be provided by monitoring such characteristics. For example, the system may be used to ensure a uniform flow of cooling fluid (e.g., cooling water) throughout the system. Further, the manifold assembly may also shut off the cooling fluid (e.g., by operation or one or more valves) when: (i) the lamp head of the light source (including the light producing elements) is not in operation; (ii) if the cooling fluid hoses/tubes are accidentally cut or are leaking; (iii) if the manifold assembly does not maintain a desired level of cooling fluid pressure; etc. As will be explained herein, in one or more embodiments, the manifold assembly may include sensors, cooling fluid hoses/tubes, plumbing fixtures, electrical/communication cables, valves (e.g., solenoid valves) and a printed circuit board.

As will be appreciated by those skilled in the art, lamp systems (and the associated cooling fluid systems) often have certain limitations and challenges. For example, specific values for cooling fluid pressure, cooling fluid pH, cooling fluid flow rate, cooling fluid temperature, etc. are desirably maintained to ensure the preferred performance of the system.

Another challenge is controlling the cooling fluid pressure during start up of the system, which tends to result in a cooling fluid pressure spike when the system is turned on. The lamp head assembly often includes elements that may be sensitive to a relatively significant start up pressure spike. In accordance with the invention, the cooling fluid pressure may be ramped according to a predefined pressure profile during the initial start up. Thus, accurate closed loop control of cooling fluid pressure is desirable.

Yet another challenge relates to extended testing on cooling fluid sources (e.g., lifetesting on a chiller, which may occur overnight). Such testing may result in a pressure leak somewhere in the system. If such a leak occurs, and the chiller runs in a dry state, this may result in damage (and possibly permanent failure) of elements of the light source system and/or the cooling system.

Yet another challenge relates to a situation where a cooling fluid line is cut, resulting in a loss of pressure, which may result in an interlock shutting off the lamp system (including a shutdown of energy, such as DC power, provided by a power supply to energize the light producing elements of the lamp head). While the elements of the lamp head system may be protected in such a situation, cooling fluid (e.g., water from a chiller) may continuously run through the leaking cooling fluid distribution system, creating a potential safety hazard.

Yet another challenge relates to distribution of the cooling fluid when the lamp is shut off. Even if there is not be a substantial safety risk, or a risk of equipment damage, if the cooling fluid continues to operate when it is not needed this results in the wasteful cooling of a lamp system (and the associated waste of energy, and related resources).

To address certain of the aforementioned issues and challenges, according to certain exemplary embodiments of the invention, a profile (e.g., a time based profile that tracks operation of the system) is developed based on the anticipated performance of the system. The profile corresponds to operation of the lamp system, with thresholds (or acceptable ranges) for each of a plurality of cooling fluid characteristics being monitored (and potentially controlled) in connection with the profile, using sensors included in the manifold assembly. Exemplary characteristics include cooling fluid pressure, cooling fluid temperature, cooling fluid pH, and cooling fluid flow rate.

Certain of the sensors included in the manifold assembly may desirably be provided in line with the cooling fluid supply (e.g., water from the chiller), with the sensors being connected (e.g., via cabling) to a printed circuit board of the manifold assembly. Such a printed circuit board may include signal conditioning circuitry for receiving, converting, and otherwise manipulating signals from the sensors. Output from the signal conditioning circuit may be used locally (at the manifold assembly) and/or may be sent via a communication link to a remote location such as a central processing unit of the power source (e.g., a power supply) that provides energy to illuminate light producing elements of the lamp head.

According to certain exemplary embodiments of the invention, and based on the desired (e.g., optimal) performance of the system, an acceptable (or unacceptable) threshold value may be established for each sensor characteristic, or an acceptable (or unacceptable) range may be established for each sensor characteristic. Real time data is collected by the plurality of sensors, where the data may be stored in memory local to the manifold assembly and/or may be sent to the processor (e.g., a microcontroller) on a printed circuit board local to the manifold assembly. As provided above, the data from the sensors (which may be reconditioned, reformatted, aggregated, mathematically manipulated, etc.) may then be transmitted via cable to a remote processor (e.g., the central processing unit of the power supply) that compares the data to the predetermined criteria for the specific characteristic being sensed. If the sensor data is outside of an acceptable predefined value (as determined using a threshold, a range, etc.), software may be used to (i) initiate a warning through a user interface (e.g., a graphical user interface, etc.), (ii) engage an interlock to shut down water flow (e.g., through valve operation), etc. The determination of whether the sensor data is acceptable (and/or the initiation of a warning or engagement of an interlock) may be accomplished by a local processor (at the manifold assembly) as opposed to the remote processor.

Figure 2:
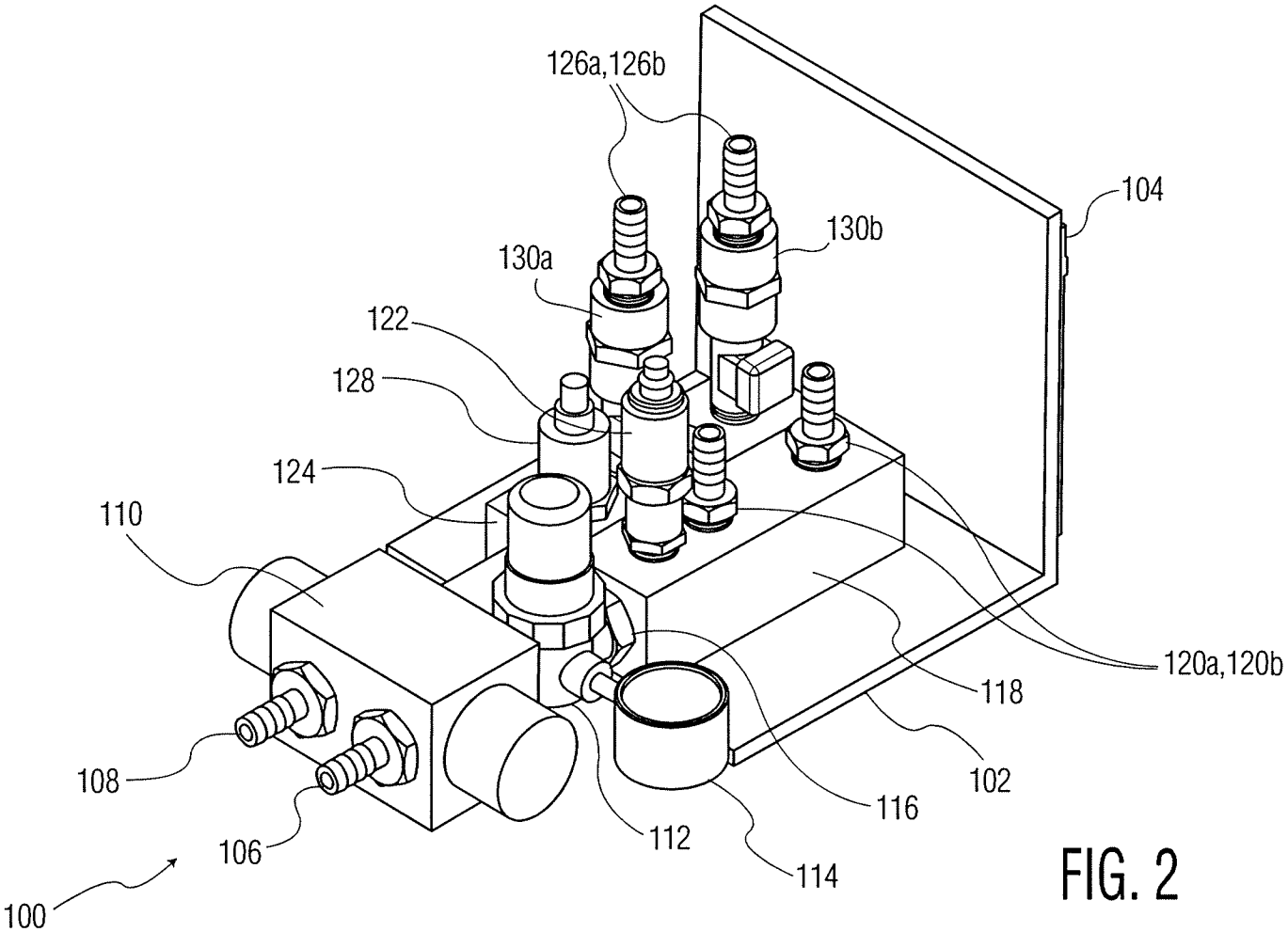
FIG. 2 is a front perspective view of the manifold assembly of FIG. 1 in accordance with an exemplary embodiment of the invention.
Figure 3:
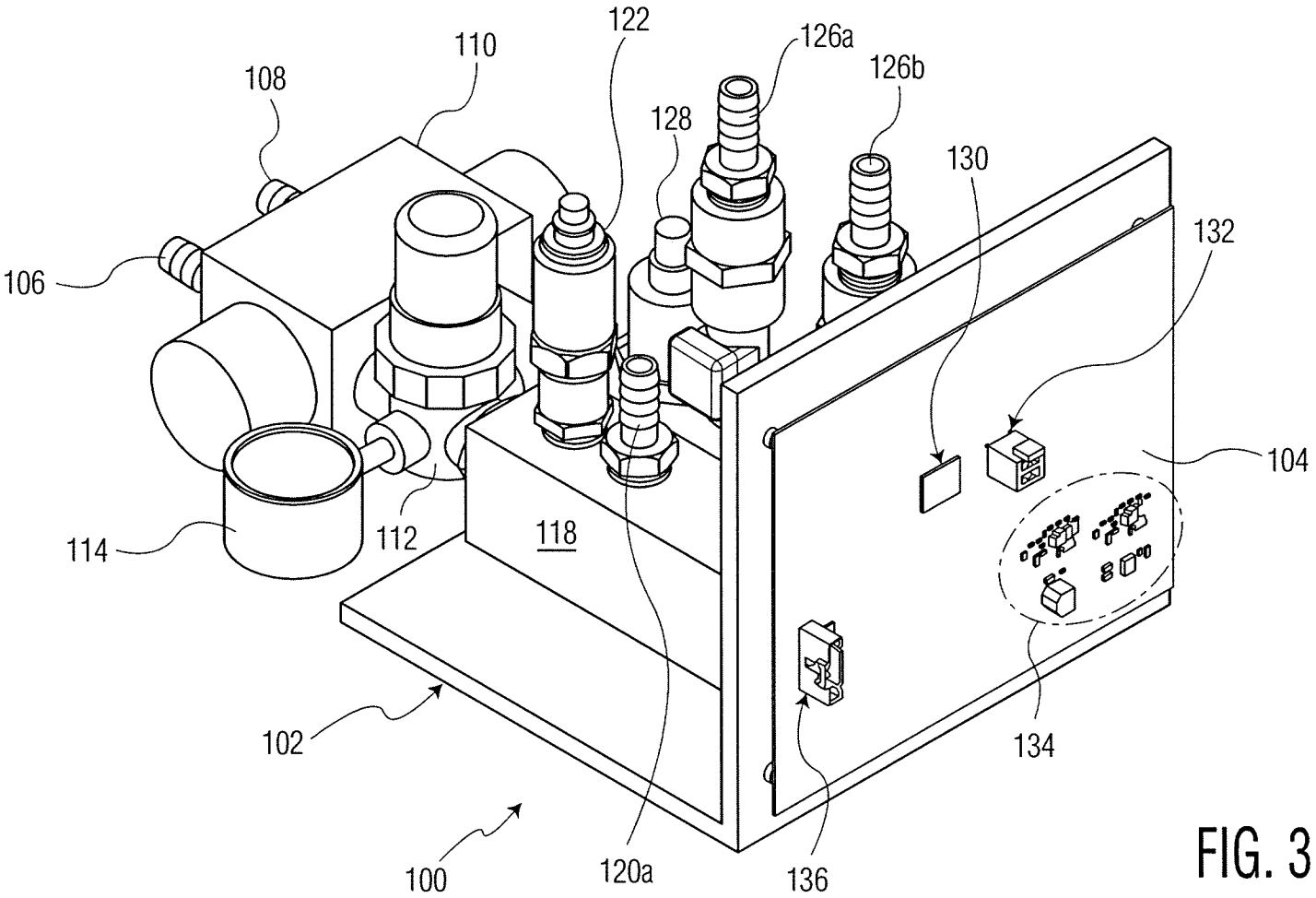
FIG. 3 is a back perspective view of the manifold assembly of FIG. 1 in accordance with an exemplary embodiment of the invention.

FIGS. 1-3 provide various views of a manifold assembly 100, illustrating various exemplary components, in accordance with one or more embodiments of the invention. A mounting bracket 102 is provided to support various components of manifold assembly 100. Manifold assembly 100 provides a cooling fluid (e.g., cooling water from a chiller such as a closed-loop chiller system, a simple heat exchanger chiller system, etc.) to a lamp head (not shown in FIGS. 1-3). The cooling fluid provided by the chiller is received at coolant supply line 106 of manifold assembly 100. The cooling fluid proceeds to inlet manifold 118, and from inlet manifold 118 the cooling fluid proceeds to provide cooling to portions of the lamp head (not shown in FIGS. 1-3) through connections 120*a*, 120*b*. As will be appreciated by those skilled in the art, the distribution of the cooling fluid in the lamp head may follow any desired path, and may include micro channels in a heat exchanger element provided adjacent the light producing elements to cool the system.

From the lamp head the cooling fluid returns to outlet manifold 124 through connections 126*a*, 126*b*, and then proceeds to coolant return line 108. From coolant return line 108 the cooling fluid returns to a cooling fluid supply (e.g., a chiller). A plurality of sensors (which may be in line with the cooling fluid supply) included in manifold assembly 100 monitor characteristics of the cooling fluid (and/or of other parts of the light source), and provide signals related to the monitored characteristics to a manifold board 104 (e.g., a printed circuit board) included in manifold assembly 100.

Manifold assembly 100 also includes a valve 110 (e.g., a solenoid valve), a pressure regulator 112, a pressure gauge 114, and a cooling fluid filter 116. The exemplary plurality of sensors shown in FIGS. 1-3 include cooling fluid pressure/temperature sensors 122, cooling fluid pH sensor 128, and cooling fluid flow sensors 130*a*, 130*b*. Of course, additional sensors are contemplated.

Referring specifically to FIG. 3, exemplary circuit elements are shown on manifold circuit board 104 including a microprocessor 130, a static memory device 132 (e.g., an electrically erasable programmable read-only memory, that is, an EEPROM), a conditioning circuit(s) 134, and a communication port 136. Signals from the plurality of sensors (including information related to the monitored characteristics) are received by microprocessor 130 after conditioning by conditioning circuit(s) 134.

Figure 4:
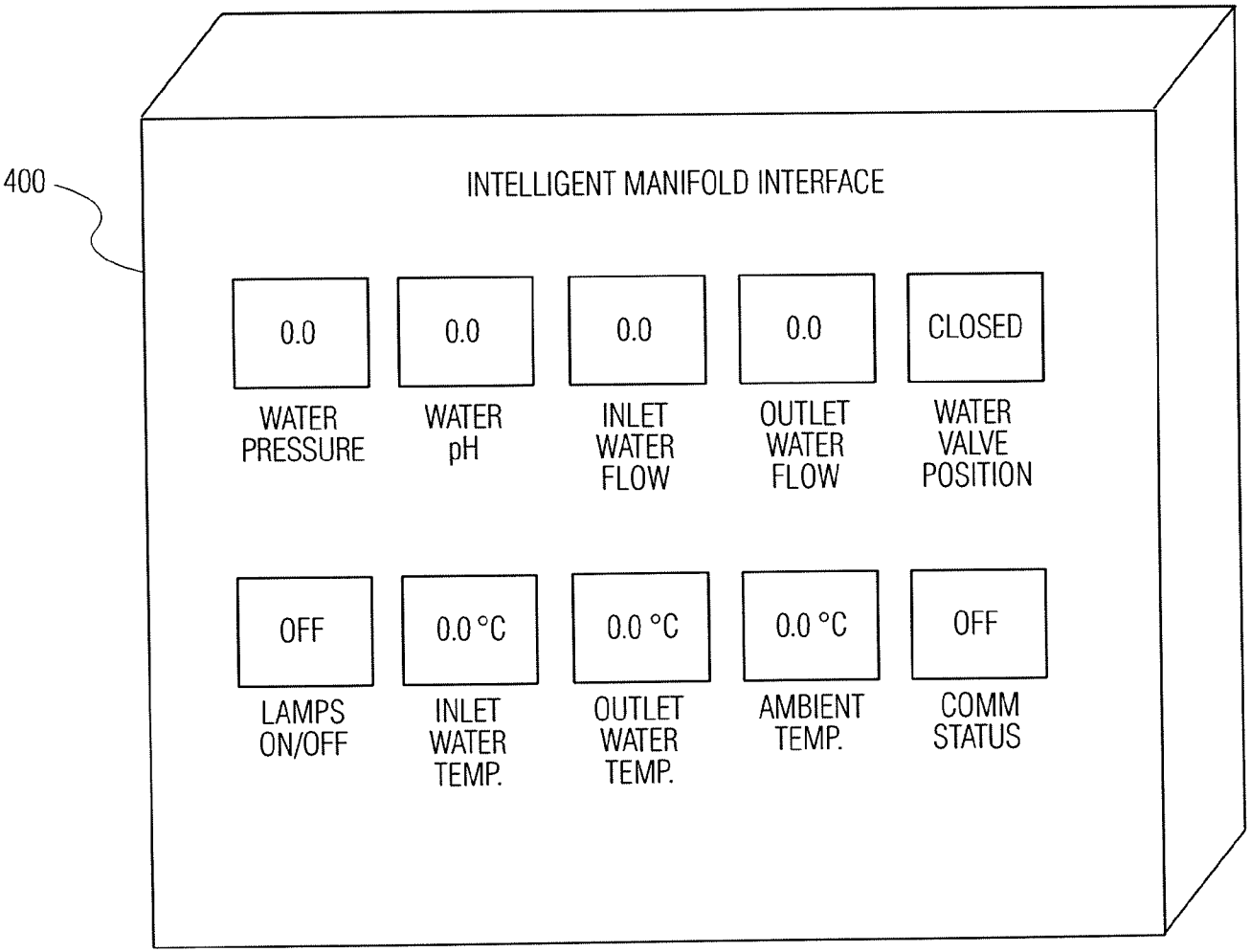
FIG. 4 is a block diagram view of a graphical user interface in accordance with an exemplary embodiment of the invention.

A user interface may be desirable, such that a user of a light source (including the manifold assembly) may visually monitor the status of certain characteristics (e.g., including certain of the monitored characteristics of the cooling fluid). FIG. 4 illustrates an exemplary graphical user interface (GUI) for a system including water as a cooling fluid. Manifold interface 400 illustrates the monitored water pressure, water pH, the inlet water flow rate, the outlet water flow rate, the water valve position, the lamp status, the inlet water temperature, the outlet water temperature, the ambient temperature, and the status of communication with manifold board 104. While FIG. 4 primarily illustrates status information (e.g., information related to the sensed cooling fluid characteristics), it is understood that such an interface may provide other functionality such as, for example, user input functionality (e.g., user control of cooling fluid characteristic setpoints, user control of cooling fluid valves, emergency stop functions, etc.).

Figure 5:
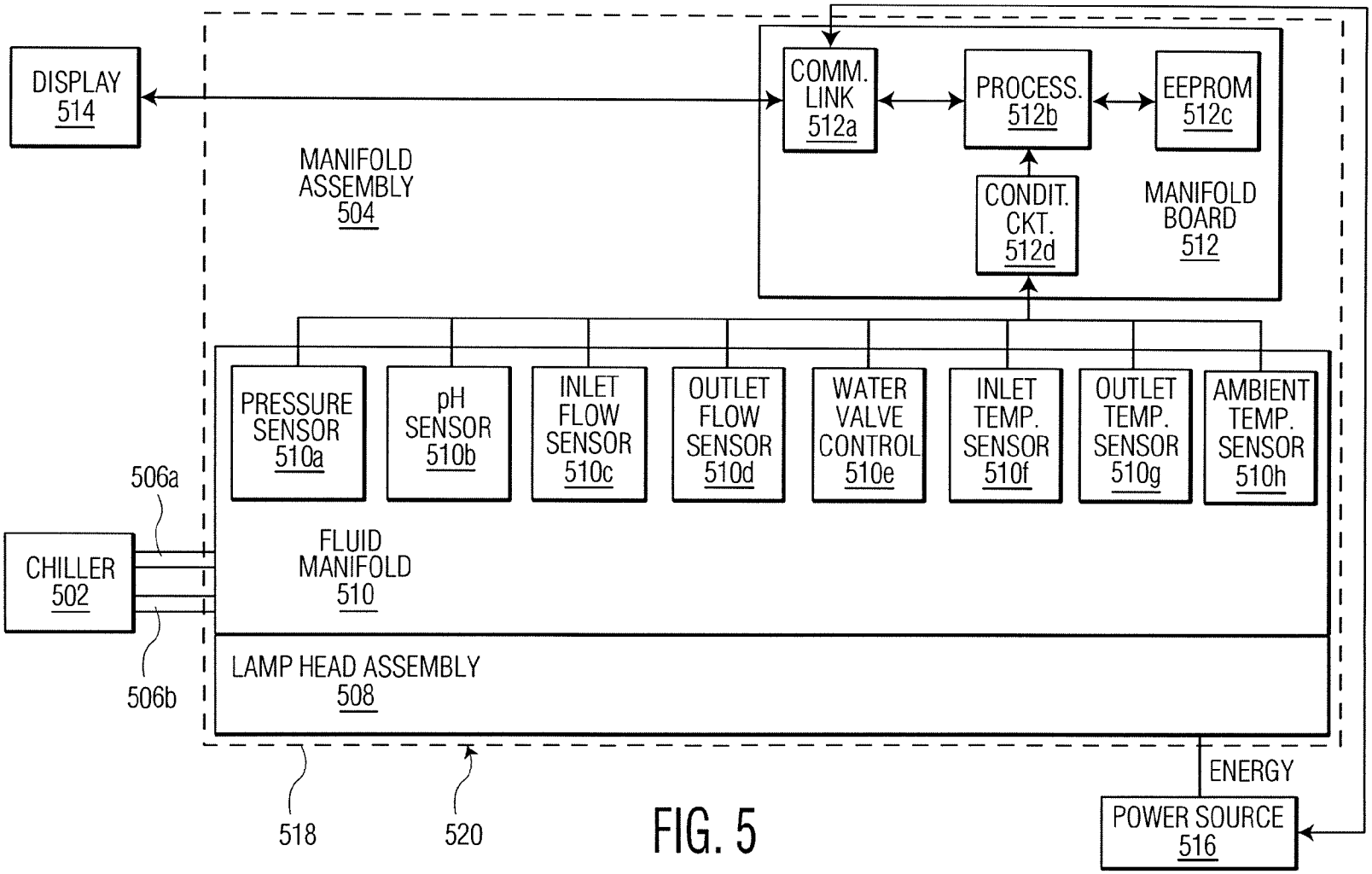
FIG. 5 is a block diagram view of an light source including a manifold assembly, and related elements, in accordance with an exemplary embodiment of the invention.

FIG. 5 is a block diagram of a light source system 500 (e.g., a UV LED system, for example, for providing UV energy for curing, etc.), where similar elements in FIG. 5 have similar functions to the same elements described in connection with FIGS. 1-3, regardless of the reference numeral differences. System 500 includes a light source 520, a chiller 502, a display 514, and a power source 516. Light source 520 includes a lamp head assembly 508 (e.g., including a plurality of light producing elements such as UV LEDs), a manifold assembly 504, and a housing 518 including the lamp head assembly and the manifold assembly. Manifold assembly 504 includes a fluid manifold 510 (e.g., including an inlet manifold such as manifold 118 in FIGS. 1-3, and an outlet manifold such as manifold 124 in FIGS. 1-3) and a manifold board 512. Fluid manifold 510 receives cooling fluid from chiller 502 via inlet piping 506*a*. Cooling fluid returns to chiller 502 via outlet piping 506*b*. Although FIG. 5 only illustrates the elements in a block diagram form, it is understood that the cooling fluid passes through fluid manifold 510 in a desired manner to cool elements of lamp head assembly 508 (e.g., to withdraw heat produced by light producing elements such as UV LEDs). FIG. 5 illustrates various exemplary sensors for sensing characteristics of fluid manifold 510, including characteristics of cooling fluid provided by chiller 502 and passing through fluid manifold 510. The illustrated sensors include a pressure sensor 510*a*, a pH sensor 510*b*, an inlet flow sensor 510*c*, an outlet flow sensor 510*d*, a water valve control 510*e* (e.g., which may be a valve position indication, valve control, etc.), an inlet temperature sensor 510*f*, an outlet temperature sensor 510*g*, and an ambient temperature sensor 510*h*. Of course, additional or different sensors are contemplated within the scope of the invention.

Signals from the various sensors are received at one or more conditioning circuits 512*d* on manifold board 512. Signals from conditioning circuit(s) 512*d* are received by processor 512*b* (e.g., a microprocessor). Processor 512*b* is in communication with EEPROM 512*c* (or another static memory device), where EEPROM 512*c* includes information related to at least one of (i) read only data related to one or more of the manifold assembly sensors, and (ii) data written by the microprocessor related to operation of the at least one sensor. That is, as used herein, the terms static memory device (including EEPROM) is intended to refer to a system that may include read only data, and memory for writing additional data. Read only data stored in EEPROM 512*c* may include, for example, sensor data for one or more of the sensors (e.g., sensor calibration data, sensor manufacturer data such as bar codes and model numbers, sensor service data, sensor warranty data, sensor inventory data, etc.) or similar information related to other parts of the manifold assembly. Data written by the microprocessor to EEPROM 512*c* may include, for example, information related to the hours of operation of each sensor, data related to characteristics of the cooling fluid sensed by each sensor, etc. A specific example of data that may be written by the microprocessor to EEPROM 512*c* may include information related to cooling fluid characteristics that exceed predetermined criteria (e.g., alarm conditions, etc.).

Processor 512*b* transmits and receives information via communication link 512*a* (e.g., a wired communication link, a wireless communication link, etc.). For example, information is provided through communication link 512*a* to display 514 (which may be an interface similar to interface 400 shown in FIG. 4). Information may be provided to processor 512*b* by a user of display 514 (e.g., a user may provide control instructions for an element of light source 520 via display 514) via communication link 512*a*. Information may also be transmitted to power source 516 (e.g., to a central processing unit of power source 516) from processor 512*b* via communication link 512*a*. Likewise, information may be transmitted to processor 512*b* from power source 516 via communication link 512*a*.

As shown in FIG. 5, power source 516 (e.g., a DC power supply) provides energy to lamp head assembly 508. As is understood by those skilled in the art, light producing elements (e.g., UV LEDs) are energized using energy provided by power source 516.

Although display 514 and power source 516 are illustrated as separate from one another, it should be understood that display 514 may be: local to power source 516; local to (and even included as part of) light source 520; or at a location distinct from both of light source 520 and power source 516.

Figure 6:
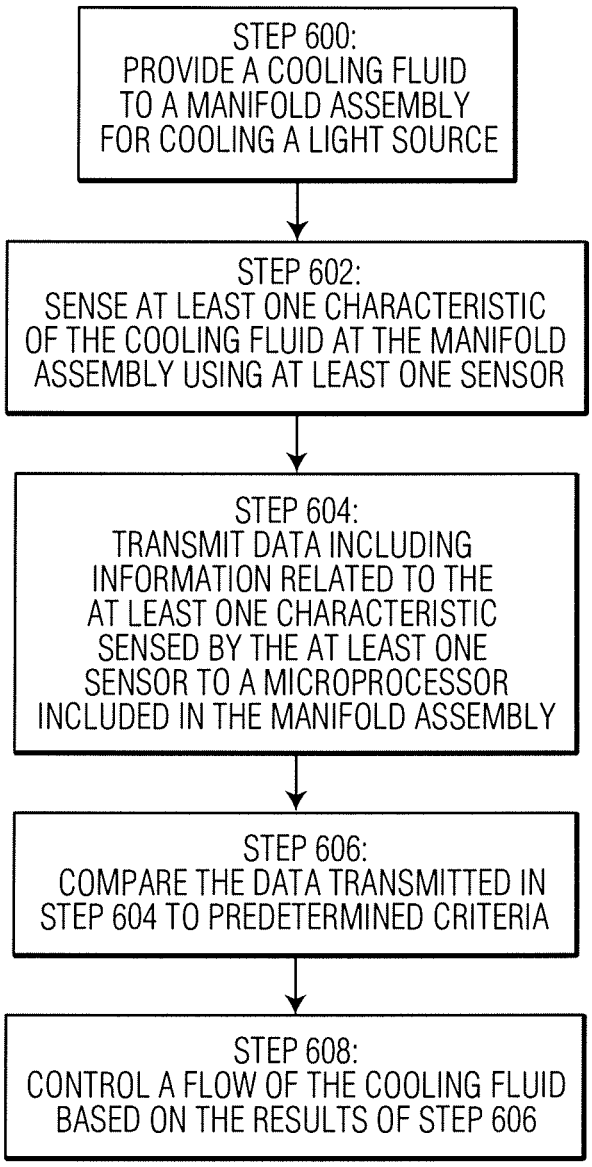
FIG. 6 is a flow diagram illustrating a method of operating a manifold assembly configured for use with a light source in accordance with an exemplary embodiment of the invention.

FIG. 6 is a flow diagram in accordance with certain exemplary embodiments of the invention. As is understood by those skilled in the art, certain steps included in the flow diagram may be omitted; certain additional steps may be added; and the order of the steps may be altered from the order illustrated.

Referring specifically to the flow diagram in FIG. 6, a method of operating a manifold assembly for providing a cooling fluid is provided. The manifold assembly is configured for use with a light source. At Step 600, a cooling fluid (e.g., water from a chiller) is provided to a manifold assembly (such as manifold assembly 100 shown in FIGS. 1-3, manifold assembly 504 shown in FIG. 5, etc.) for cooling a light source (e.g., a UV LED light source for performing curing operations). At Step 602, at least one characteristic of the cooling fluid at the manifold assembly is sensed using at least one sensor (e.g., a pressure sensor for sensing a pressure of the cooling fluid, an inlet flow sensor for sensing a flow value of the cooling fluid into the fluid manifold, an outlet flow sensor for sensing a flow value of the cooling fluid out of the fluid manifold, a temperature sensor for measuring a temperature of the cooling fluid in the manifold assembly, and a pH sensor for measuring a pH of the cooling fluid in the manifold assembly). At Step 604, data including information related to the at least one characteristic sensed by the at least one sensor is transmitted to a microprocessor (e.g., microprocessor 130 in FIG. 3, processor 512*b* shown in FIG. 5, etc.) included in the manifold assembly. At Step 606, the data transmitted in step 604 is compared to predetermined criteria—where the predetermined criteria may include an acceptable (or unacceptable) threshold level, an acceptable (or unacceptable) range, etc. For example, the data transmitted may be formatted (e.g., mathematically manipulated) for comparison to the predetermined criteria. At Step 608, a flow of the cooling fluid is controlled based on the results of step 606. For example, if it is determined that there is a leak in the cooling fluid system of the manifold assembly (e.g., as determined by a pressure value, provided by a cooling fluid pressure sensor in the manifold assembly, being outside of an acceptable predetermined range), the lamp head may be shut down (e.g., by a central processing unit of the power source, such as power source 516 in FIG. 4), and flow of the cooling fluid may be stopped (e.g., by closure of one or more valves in the manifold assembly such as valve 110 shown in FIGS. 1-3). The comparison in Step 606 may be accomplished by the microprocessor at the manifold assembly (e.g., microprocessor 130 in FIG. 3), or by another microprocessor (e.g., a central processing unit at the power source).

Thus, as described herein, embodiments of the disclosure may provide a proactive approach to the chiller by building an intelligent manifold system. The intelligent manifold system can proactively monitor key indicators to ensure the health of the system, promote safety, and permit users to schedule maintenance for their systems. Performance of the cooling fluid source (e.g., the chiller) may also be monitored.

Certain embodiments of the invention may provide one or more of the following advantages. A modular manifold assembly, and a modular light source including the manifold assembly, is provided, which has application in a variety of applications, and with a variety of cooling fluid sources. The invention provides a proactive approach to manifold assembly maintenance because (i) of the monitoring of the various fluid characteristics of the manifold assembly, and/or (ii) because of the information available in the static memory device (e.g., an EEPROM) at the fluid manifold (e.g., maintenance instructions related to the manifold assembly, for example, a filter change being needed). The invention provides real time data monitoring, and may be used to ensure substantially uniform flow distribution. The invention may include embodiments where both an inlet and an outlet cooling fluid temperature is sensed, for example, to determine if the chiller is malfunctioning or is underrated. As described above, if the cooling fluid lines are damaged (e.g., cut), a valve(s) may be used to shut off the cooling fluid to and from the lamp head assembly. Likewise, if the lamp head assembly is off, the valve(s) may be used to close the supply of cooling fluid, thereby saving energy.

Although the invention is primarily described in connection with a processor at a printed circuit board of the manifold assembly, it is understood that the processor may be located at another location of the light source such as, for example, a circuit board including the lamp head driver circuitry. Further, multiple circuit boards may be provided to include the various circuit elements of the manifold assembly.

Although the invention has largely been described in connection with solid state light sources, it is not limited thereto. That is, the teachings of the invention may be applied to a wide range of light source systems including any system utilizing active cooling, and that preferably is enables by continuous monitoring of characteristics of the light source system and/or a cooling system of the light source system.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A manifold assembly for distribution of a cooling fluid configured for use with a light source, the manifold assembly comprising:

(a) a fluid manifold for providing a cooling fluid to a lamp head assembly of the light source;

(b) at least one sensor for sensing at least one characteristic of the cooling fluid in the fluid manifold;

(c) a microprocessor for receiving information related to the at least one characteristic from the at least one sensor; and (d) a static memory device in communication with the microprocessor, the static memory device including at least one of (i) read only data related to the at least one sensor, and (ii) data written by the microprocessor related to operation of the at least one sensor.

2. The manifold assembly of claim 1 wherein the light source is an ultraviolet (UV) light source, the UV light source including at least one of a UV laser, a UV LED light source, and a vertical cavity surface emitting laser (VCSEL).

3. The manifold assembly of claim 1 wherein the light source is a visible light source.

4. The manifold assembly of claim 1 wherein the microprocessor is included on a board included in the manifold assembly.

5. The manifold assembly of claim 4 wherein the static memory device includes an EEPROM on the board in communication with the microprocessor.

6. The manifold assembly of claim 1 wherein the at least one sensor includes (i) a pressure sensor for sensing a pressure of the cooling fluid, (ii) an inlet flow sensor for sensing a flow value of the cooling fluid into the fluid manifold, (iii) an outlet flow sensor for sensing a flow value of the cooling fluid out of the fluid manifold, (iv) an inlet temperature sensor for measuring a temperature of the cooling fluid in the manifold assembly, (v) an outlet temperature sensor for measuring a temperature of the cooling fluid in the manifold assembly, and (vi) a pH sensor for measuring a pH of the cooling fluid in the manifold assembly.

7. The manifold assembly of claim 1 wherein the fluid manifold includes an inlet manifold for providing the cooling fluid to the lamp head assembly, and an outlet manifold for receiving the cooling fluid from the lamp head assembly.

8. The manifold assembly of claim 1 further comprising a graphical user interface in communication with the microprocessor for displaying information related to the at least one characteristic sensed by the at least one sensor.

9. The manifold assembly of claim 1 wherein the microprocessor communicates with a central processing unit of a power source for providing energy for energizing the light source.

10. The manifold assembly of claim 1 wherein the microprocessor is configured to control a flow of the cooling fluid upon an occurrence of a predetermined condition sensed by the at least one sensor.

11. A light source comprising:

(a) a lamp head assembly including at least one light producing device; and (b) a manifold assembly for distributing a cooling fluid, the manifold assembly being configured for use with the lamp head assembly, the manifold assembly including (i) a fluid manifold for providing the cooling fluid to the lamp head assembly, (ii) at least one sensor for sensing at least one characteristic of the cooling fluid in the fluid manifold, (iii) a microprocessor for receiving information related to the at least one characteristic of the cooling fluid sensed by the at least one sensor, and (iv) a static memory device in communication with the microprocessor, the static memory device including at least one of (i) read only data related to the at least one sensor, and (ii) data written by the microprocessor related to operation of the at least one sensor.

12. The light source of claim 11 wherein the at least one light producing device includes a UV light producing device, the UV light producing device including at least one of an LED lamp and a laser lamp.

13. The light source of claim 12 further comprising a power source for energizing the UV light producing device.

14. The light source of claim 11 wherein the microprocessor is included on a printed circuit board included in the manifold assembly.

15. The light source of claim 14 wherein the static memory device includes an EEPROM on the printed circuit board in communication with the microprocessor.

16. A method of operating a manifold assembly for distributing a cooling fluid, the manifold assembly being configured for use with a light source, the method comprising the steps of:

(a) providing a cooling fluid to the manifold assembly for cooling a light source;

(b) sensing at least one characteristic of the cooling fluid at the manifold assembly using at least one sensor;

(c) transmitting data including information related to the at least one characteristic sensed by the at least one sensor to a microprocessor included in the manifold assembly, and (d) communicating, by the microprocessor, with a static memory device of the manifold assembly, the static memory device including at least one of (i) read only data related to the at least one sensor, and (ii) data written by the microprocessor related to operation of the at least one sensor.

17. The method of claim 16 further comprising a step of operating a flow of the cooling fluid based on the information transmitted to the microprocessor in step (c).

18. The method of claim 17 wherein the step of operating the flow of the cooling fluid includes operating at least one valve to shut off flow of the cooling fluid to the manifold assembly.

19. The method of claim 16 further comprising a step of providing a warning indication if the information transmitted in step (c) related to the at least one sensed characteristic exceeds a predetermined warning threshold, or falls within a predetermined warning range.

20. The method of claim 16 further comprising a step of shutting off flow of the cooling fluid to the manifold assembly (i) if the information transmitted in step (c) related to the at least one sensed characteristic exceeds a predetermined shut off threshold, or (ii) if the information transmitted in step (c) related to the at least one sensed characteristic falls within a predetermined shut off range.

* * * * *